US006524026B2

(12) United States Patent
Sondrup

(10) Patent No.: US 6,524,026 B2
(45) Date of Patent: Feb. 25, 2003

(54) ADJUSTABLE HEIGHT UTILITY ACCESS DEVICE

(75) Inventor: Chris Sondrup, Lindon, UT (US)

(73) Assignee: Precision Cover Systems, Inc., Lindon, UT (US)

( * ) Notice: Subject to any disclaimer, the term of this patent is extended or adjusted under 35 U.S.C. 154(b) by 0 days.

(21) Appl. No.: 09/814,627

(22) Filed: Mar. 22, 2001

(65) Prior Publication Data

US 2002/0136604 A1 Sep. 26, 2002

(51) Int. Cl.[7] ..... E02D 29/14
(52) U.S. Cl. ..... 404/26
(58) Field of Search ..... 404/26

(56) References Cited

U.S. PATENT DOCUMENTS

| | | | | | |
|---|---|---|---|---|---|
| 275,785 | A | * | 4/1883 | Omensetter | 404/26 |
| 599,441 | A | * | 2/1898 | Dorr | 404/26 |
| 638,692 | A | * | 12/1899 | Banwell | 404/26 |
| 689,224 | A | * | 12/1901 | Pillsbury | 404/26 |
| 814,013 | A | * | 3/1906 | Baumann | 404/26 |
| 1,165,044 | A | * | 12/1915 | Tyler | 404/26 |
| 1,257,324 | A | * | 2/1918 | Daniels | 404/26 |
| 1,447,256 | A | * | 3/1923 | Lincoln | 404/26 |
| 1,639,495 | A | * | 8/1927 | Frame | 404/26 |
| 3,611,889 | A | * | 10/1971 | Levinson | 404/26 |
| 4,174,183 | A | * | 11/1979 | Ferns | 404/26 |
| 4,197,031 | A | * | 4/1980 | Hild | 404/26 |
| 4,273,467 | A | | 6/1981 | Cronk | |
| 4,337,005 | A | | 6/1982 | LeBaron | |
| 4,906,128 | A | * | 3/1990 | Trudel | 404/26 |
| 4,969,770 | A | * | 11/1990 | Bowman | 404/26 |
| 5,051,022 | A | * | 9/1991 | Bowman | 404/26 |
| 5,211,504 | A | * | 5/1993 | Trudel | 404/26 |
| 5,360,131 | A | * | 11/1994 | Phillipps et al. | 220/8 |
| 5,366,317 | A | | 11/1994 | Solimar | |
| 5,451,119 | A | | 9/1995 | Hondulas | |
| 5,470,172 | A | | 11/1995 | Wiedrich | |
| 5,496,128 | A | | 3/1996 | Odill | |
| 5,513,926 | A | * | 5/1996 | Prescott | 404/26 |
| 5,564,855 | A | | 10/1996 | Anderson | |
| 5,813,797 | A | * | 9/1998 | Pendleton et al. | 141/86 |
| 5,956,905 | A | | 9/1999 | Wiedrich | |

* cited by examiner

*Primary Examiner*—Gary S. Hartmann
(74) *Attorney, Agent, or Firm*—Thorpe North & Western

(57) ABSTRACT

The present invention relates to a height adjustable utility access device, such as a manhole, which adjusts in height to allow a top of a cover to sit flush with the surrounding surface, such as a road. The device has a cover which covers access to the utility; a frame coupled over the utility; and an adjuster, coupled between the cover and the frame, for adjusting the height of the cover relative to the frame. The adjuster can include an adaptor ring on the frame, and an extension ring on the adaptor ring. The extension ring can have tabs which selectively engage a plurality of steps on the adaptor ring. Alternatively, the steps can be formed directly in the frame. Alternatively, first and second rings can be disposed between the frame and cover. The rings can have meshing steps.

7 Claims, 6 Drawing Sheets

ADJUSTABLE HEIGHT UTILITY ACCESS DEVICE

RELATED APPLICATIONS

The present application is related to U.S. patent application Ser. No. 09/653,714, filed Sep. 1, 2000, entitled "Adjustable Manhole Apparatus", inventor Chris Sondrup.

THE FIELD OF THE INVENTION

The present invention relates generally to a utility access, such as a manhole. More particularly the present invention relates to a height adjustable utility access or manhole having a variable cover height adjustment to allow the top of the cover to sit flush with the surrounding surface, such as a road.

BACKGROUND OF THE INVENTION

A manhole is an opening in any surface large enough to allow workmen to descend beneath the surface to obtain access to stored materials or equipment or underground installations. The openings are normally in areas carrying traffic so that a means of securely framing and covering the opening must be provided. The manholes must also be strong enough to withstand various external loadings, for example the loading of vehicles moving over the manhole.

In the prior art, the standard procedure has been to frame the opening with a grey iron casting. For example, D& L Supply, of 880 West 150 North, in Lindon, Utah 84042, sells various styles of manhole assemblies. These castings typically incorporate a flanged surface that rests on a supporting structure that is located underground. This supporting structure typically comprises of standard concrete rings long enough so that a number of them form a passage to reach the underground installation. The flanged surface of the manhole transmits the weight of the equipment, together with live surface loads, to the supporting structure. The frame typically incorporates a projecting ledge around the circumference and a cast iron cover rests on the ledge and closes the manhole. The cover is a removable casting designed to carry the surface loads, and must transmit those forces to the underground supporting structure through the frame. The cover must be heavy to avoid vandalism. In some cases it is bolted down in order to make the installation water tight and tamper proof.

In one situation, a subsequent layer of surfacing material (for example, asphalt) is added to the road surface. When this happens, the manhole may need to be adjusted to match the height of the new road. Typically, adjustment is done by filling the space between the manhole top structure and the supporting manhole frame structure with layers of bricks and mortar. This is a manual, time-consuming procedure. In addition, spacers may be used.

Examples of patents related to the present invention, each of which are incorporated herein by reference for their supporting teachings, are as follows:

One patent which illustrates an adjustable manhole is U.S. Pat. No. 4,273,467 to Cronk. The device designed by Cronk is an adjustable manhole cover support. The support comprises of an outer ring having a circular internal opening. Threaded members are disposed about the interior of the circular opening. An insert is dimensioned to fit within the outer ring to a depth controlled by the abutment of the insert against the threaded members. Studs engage and extend through the threaded members to abut the under surface of the insert to provide control of the depth of the insert into the outer ring and the angulation of the outer ring. The support is simple to make, easy to adjust and trouble-free in operation.

U.S. Pat. No. 5,496,128, is an internal fastening band for an internal manhole chimney seal, as well as a means for expanding the band and a means for removing the band. One end of the band is narrower than the other end so that when overlapped the ends of the band nest into one another to form a continuous expansion band. The first end portion has a plurality of apertures longitudinally spaced along the fastening band, and a plurality of slots spaced between the apertures at the end of the fastening band. The second end portion also has an aperture along a tab for engaging one of the slots to connect the first end portion to the second end portion with the particular slot being selected to adjust the continuous circular fastening band to a desired diameter. A tool is described for engaging an aperture in each end portion to increase the diameter of the circular expansion band and force the resilient sleeve against the inside surface of the manhole. An attachment for this tool enabling the removal of this band is also disclosed.

A further related U.S. Pat. No. is 5,564,855, which discloses a stackable height adjustment ring for supporting a manhole cover frame upon a concrete manhole shaft liner that has a ring body that is formed from plastic resin. The ring includes inner and outer radially spaced apart side walls, and optionally, a top wall. Brace arms that are integral with the walls preferably extend radially between the walls for holding them together. The rings have alignment members, e.g., an inner wall of tiering may have an upwardly facing shoulder upon its upper edge and the outer wall, a downwardly facing shoulder on its lower edge. An upwardly extending cylindrical collar at the top of the outer ring fits the downwardly facing shoulder of an adjacent ring. There is also a downwardly extending collar at the lower end of the inner ring to fit on the upwardly facing shoulder of a similar inner ring. The alignment members enable each ring to be held in alignment upon each successive ring beneath it so that the rings can be stacked one upon another to adjust the elevation of the manhole cover frame above a concrete manhole shaft liner. Optionally, the rings have engageable ramps for adjusting the pitch of an upper one of two stacked rings.

A similar U.S. Pat. No. 5,956,905, is a molded plastic extension member for use in increasing the height of manholes, or catch basins when surfacing or resurfacing a roadway. The extension member may be formed having a sloping upper planar support surface to thereby adjust the angle of the catch basin support frame or the manhole cover support frame. An outer surface of the extension member includes indicia that allows the user to align the slope of the upper planer support frame. An outer surface of the extension member includes indicia that allows the user to align the slope of the upper planar support surface parallel with the roadway surface. When several sloped extension members are stacked, the indicia may be used to create a complex angle of slope relative to the underlying base members vertical axis. The extension member includes a pocket adaptable for receiving and retaining mortar between two stacked extensions. Planar surfaces may extend from both the upper and lower edge of the extension member, thereby providing support and added stacking surface for the stacked extension members. The extension member also includes a tapered shoulder that interlocks with either the manhole cone, the catch-basin cone, or with other stackable angled plastic members.

Yet a further prior art U.S. Pat. No. 4,337,005, is concerned with an apparatus for enabling extension or other leveling adjustment of manhole cover supporting structures and the like comprising extension spacer rings resiliently compressed in self-storing fashion adjacent a support sleeve portion of the supporting structure, and adapted to be faced downward from storage to expand into position below the sleeve to extend or adjust the level of the same.

Another manhole cover U.S. Pat. No. 5,366,317, includes a collar defining an opening with an inner perimeter is provided with a pivotally mounted cover having an outer perimeter greater than the inner perimeter of the collar. A seal is provided to seal between the cover and the collar. Closure structure is provided to secure the free end of the cover to the collar. A threaded bolt is provided to close the cover. A pivotally mounted lever arm is mounted to the bolt for turning of the bolt. An adjustable threaded hinge is provided to adjust the cover in a longitudinal direction relative to the collar. The manhole cover apparatus is useable on pressure containers, such as those used to pneumatically handle particulate material.

U.S. Pat. No. 5,451,119, is a barrel-shaped manhole frame for receiving a manhole cover is provided with an inwardly directed peripheral flange at its lower end having circumferentially spaced, inclined grooves to receive wedges that can be driven into surrounding earthwork to wedge the frame upwardly and thereby adjust its height and slope to conform with a roadway or sidewall surface under construction.

Additionally, U.S. Pat. No. 5,470,172, is a molded plastic extension member for use in increasing the height of manholes, or catch basins when surfacing or resurfacing a roadway is described. A wedge to adjust the angle of the catch basin support frame or the manhole cover support frame is also described. The extension includes a pocket for reducing the total surface area of the molded plastic member. It also includes a shoulder that interlocks with either the manhole cone, the catch basin cone, or with other stackable molded plastic members. The extension also contains a planer support surface which provides rigidity and support, and provides a surface for caulking to be applied to form a watertight seal.

SUMMARY OF THE INVENTION

It has been recognized that it would be advantageous to develop an improved utility access or manhole top structure which is adjustable in height. In addition, it has been recognized that it would be advantageous to develop a utility access or manhole with a variable cover height adjustment to allow the top of the cover to sit flush with the surrounding surface, such as a road.

The invention provides a height adjustable utility access device with a height adjustment means for adjusting the height of a cover relative to a frame. Thus, the cover can be positioned flush with a surface, such as a roadway. The utility access can be a manhole.

The frame can be secured to a support surface over a utility, such as a manhole extension. The frame has an opening therethrough to provide access to the utility. The cover is removably disposed over the opening of the frame. The height adjustment means is disposed between the frame and the cover.

The height adjustment means can include a first position that maintains the cover at a first height, and a different second position that maintains the cover at a different second height. The height adjustment means can include a plurality of positions for a plurality of heights.

In accordance with one aspect of the present invention, the height adjustment means can include a plurality of steps or pockets formed about a circumference of the opening. The steps can be disposed at different elevations, or the pockets can have bottoms disposed at different elevations. At least one mating tab selectively mates or engages with at least one of the steps or pockets, to selectively position the tab, and thus the cover, at a desired elevation or height.

In accordance with another aspect of the present invention, the height adjustment means can include an extension or extension ring disposed on the frame. The extension ring can have the least one tab formed thereon.

In accordance with another aspect of the present invention, the plurality of steps or pockets can be formed in an adaptor or adaptor ring. The adaptor ring can be disposed on the frame and receive the extension ring. Thus, the height adjustment means can be used with a standard frame. Alternatively, the plurality of steps or pockets can be formed directly in the frame, with the frame receiving the extension ring.

In accordance with another aspect of the present invention, the plurality of steps or pockets can include a wall disposed between a step and a proximal step, to prevent the tab from inadvertently moving from the step to the proximal step.

In accordance with another aspect of the present invention, the height adjustment means can include a pair of rings disposed between the frame and the cover. A first ring is disposed on the frame and has a plurality of steps at different elevations. A second ring is disposed on the first ring and has a plurality of steps at different elevations. The plurality of steps of the first and second rings selectively engage to selectively elevate the second ring with respect to the first ring.

In accordance with another aspect of the present invention, the device can include at least one projection extending outwardly from the frame and past a perimeter thereof. The protrusion can resist movement or pivoting of the frame after installation.

Additional features and advantages of the invention will be set forth in the detailed description which follows, taken in conjunction with the accompanying drawings, which together illustrate by way of example, the features of the invention.

DETAILED DESCRIPTION OF THE PREFERRED EMBODIMENT

Figure 1:
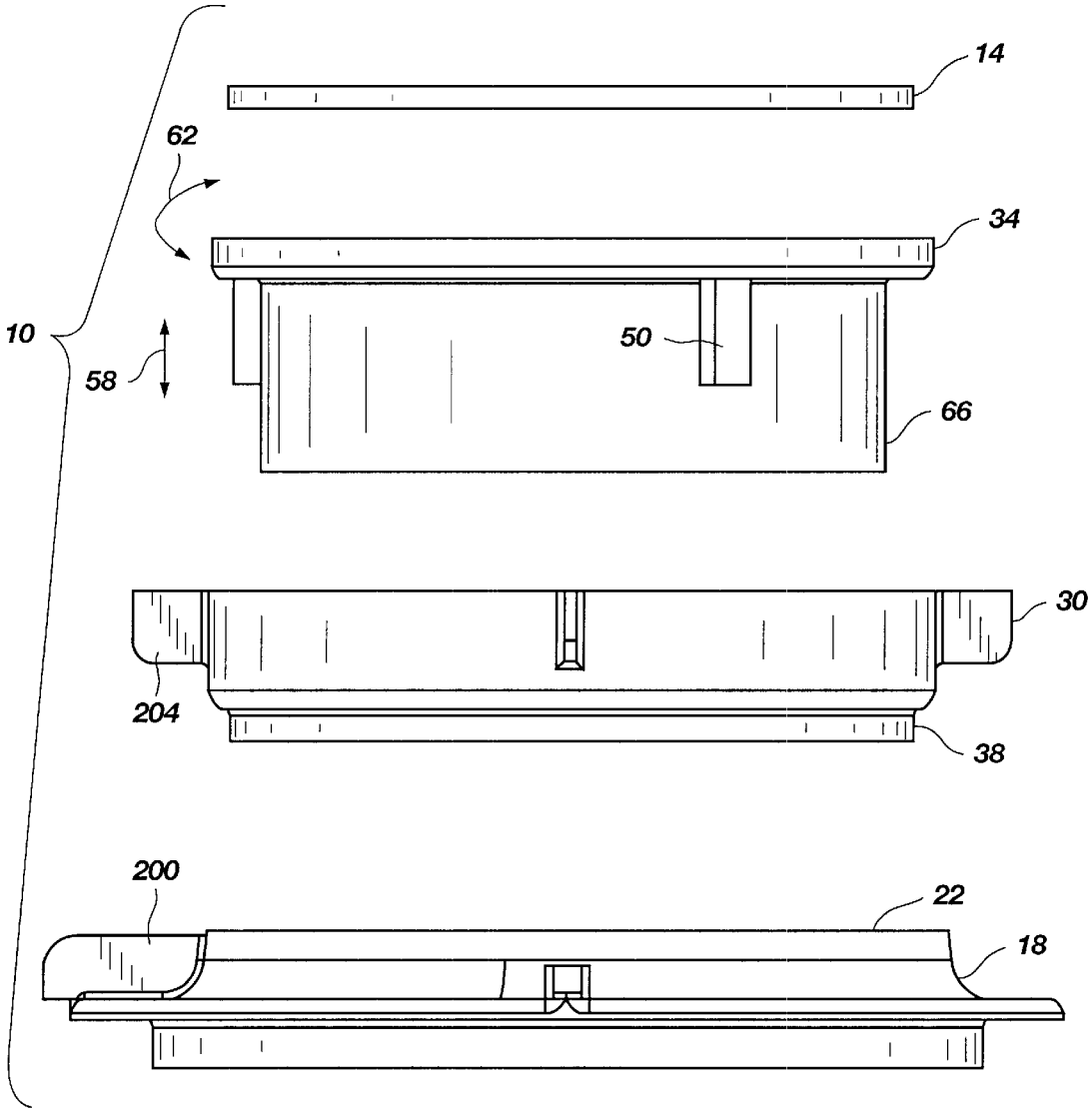
FIG. 1 is an exploded side view of a utility access device in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

As illustrated in FIG. 1, a height adjustable utility access device, indicated generally at 10, in accordance with the present invention is shown for adjusting the height of a cover 14 to be flush with a surface (not shown), such as a roadway. Manhole openings or manhole access is one example of a field which may benefit from use of such a device 10. Thus, the utility access device 10 is illustrated and described herein as being configured for use as a manhole for providing access to a utility beneath a roadway. It is of course understood that the utility access device 10 of the present invention can be configured for access to any structure, storage, or utility, including for example, water lines, water valves, water meters, gas lines, gas valves, cable lines and equipment, electrical lines and equipment, etc.

Figure 4:
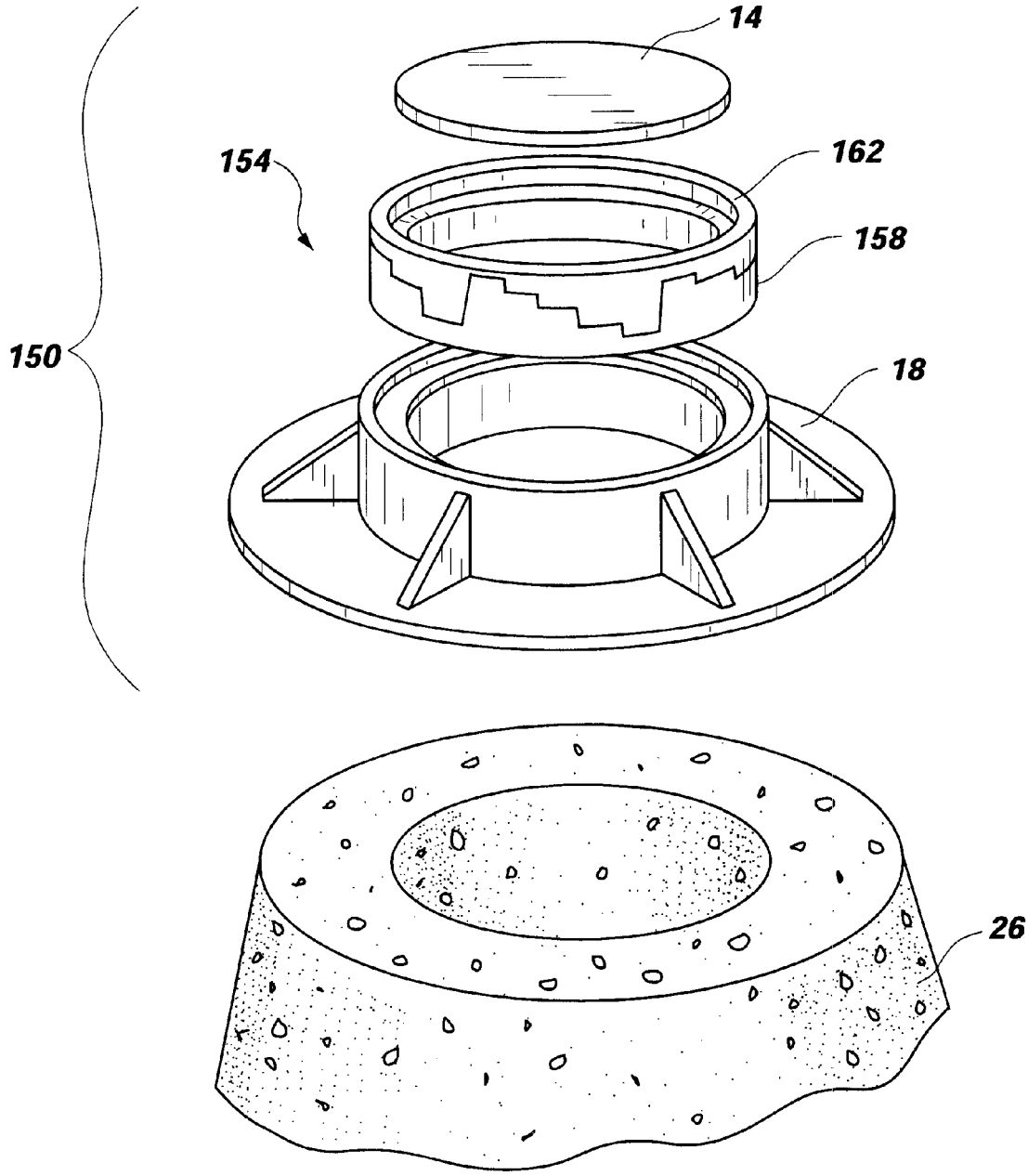
FIG. 4 is an exploded perspective view of another utility access device with a height adjustment mechanism in accordance with the present invention.

The utility access device 10 can include the cover 14 and a frame or manhole ring 18. The frame 18 has an opening 22 therethrough for providing access therethrough to a utility. The cover 14 covers the opening 22. The frame 18 can be disposed on or attached to a manhole extension 26 (FIG. 4). The manhole extension 26 (FIG. 4) is usually made of concrete and has an hole forming a vertical shaft for workmen to climb down for access to underground utilities, storage or structures. Typically, the frame 18 and manhole extension 26 are located underneath a surface, such as a roadway, and the cover 14 must be flush with the surface or roadway.

The utility access device 10 advantageously includes a height adjustment mechanism or means for adjusting the height of the cover 14 with respect to the frame 18, and thus with respect to a surface or roadway. Preferably, the utility access device 10 includes an adaptor or adaptor ring 30, and an extension or extension ring 34. The adaptor ring 30 is disposable on, and engages, the frame 18, while the extension ring 34 is disposed on, or received by the adaptor ring 30. The cover 14 is removably disposed on the extension ring 34, and thus is removably disposed over the opening 22 of the frame 18. Both the adaptor ring 30 and extension ring 34 can be annular or ring-like, and have access holes formed therethrough. It is of course understood, that the adaptor 30 and extension 34 can be of any shape.

The frame 18 preferably is a standard frame configured to receive a standard cover 14. Thus, the adaptor ring 30 can have a lip 38 sized and shaped to be received by the frame 18, similarly to how the cover 14 would be received. Similarly, the cover 14 preferably is a standard cover. Thus, the extension ring 34 can have an opening 42 (FIG. 3) sized and shaped to receive the cover 14.

Figure 2:
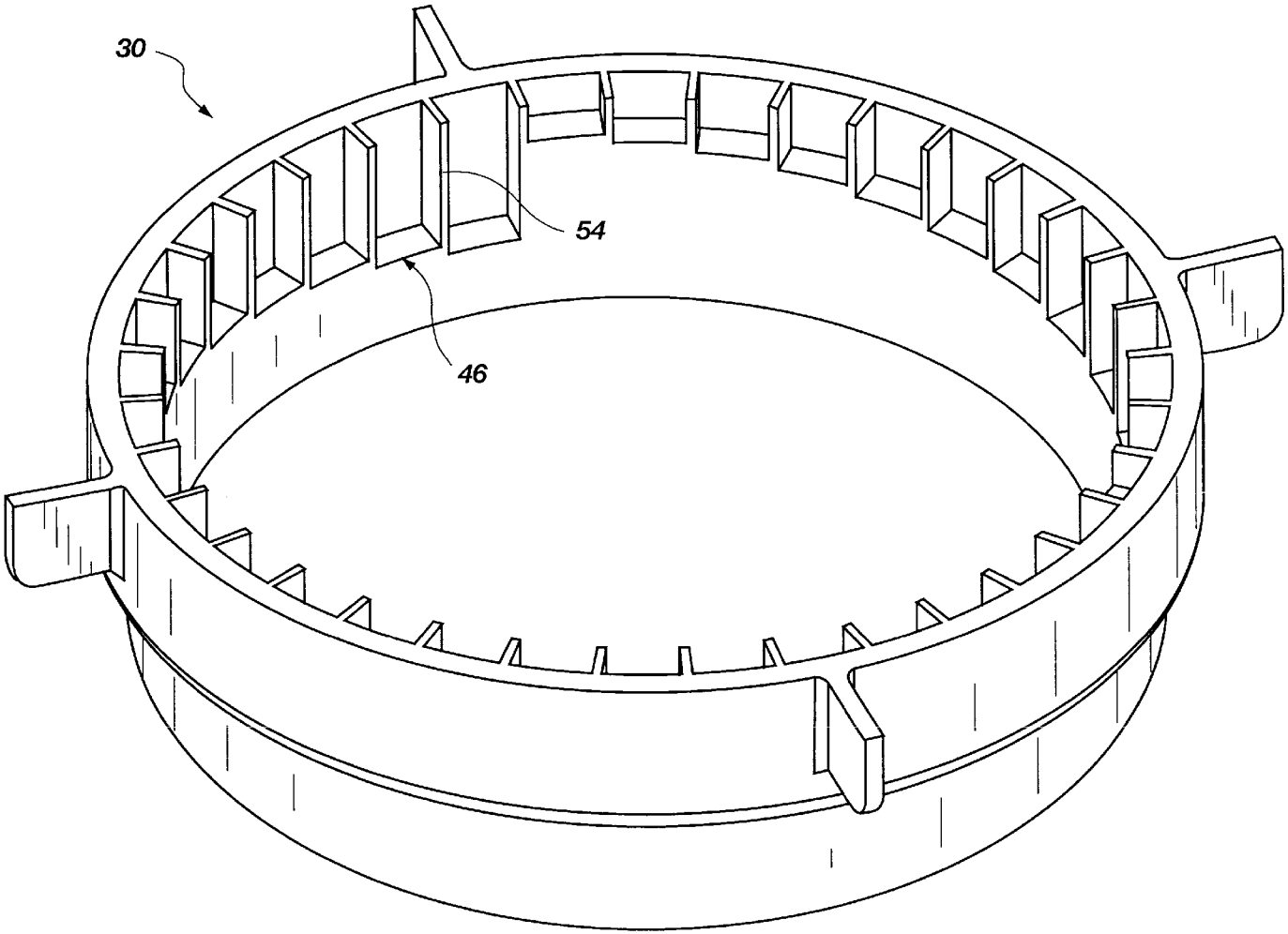
FIG. 2 is a perspective view of an adaptor ring with a plurality of steps of the utility access device of FIG. 1.

The adaptor ring 30 advantageously includes a plurality of steps or pockets 46, as shown in FIG. 2, while the extension ring 34 includes one or more mating tabs 50 which engage or selectively mate with the steps or pockets 46 to selectively position the tabs 50, and thus the extension ring 34 and cover 14, at a desired elevation. Referring to FIG. 2, the plurality of steps or pockets 46 can be formed in an inner surface or circumference of the adaptor ring 30, and are disposed at different elevations. The plurality of steps or pockets 46 preferably includes three sets of steps or pockets, each with a matching plurality of steps or pockets. It is believed that three sets of steps or pockets, and three tabs 50 (FIG. 1) provides the greatest stability between the adaptor ring 30 and extension ring 34 (FIG. 1), and greatest flexibility in tolerances For example, it is believed that three tabs 50 (FIG. 1) can engage or rest on three steps 46 without wobbling, and without meeting exacting tolerances.

As discussed above, the plurality of steps or pockets 46 can be conceptualized in different ways. The adaptor ring 30 can have a plurality of steps arranged in a stair-like fashion around the interior of the adaptor ring 30, with each subsequent step being at a higher or lower elevation as the steps extend around the adaptor ring 30. The adaptor ring 30 also. can have a plurality of pockets or indentations formed in the inner surface and upper edge of the adaptor ring 30. The pockets can have bottom walls at different elevations, or the pockets can have different depths from the upper edge. In addition, adjacent steps or pockets 46 can be separated by walls 54 which prevent the tabs 50 (FIG. 1) from inadvertently moving from one step to another. For example, a wall 54 can be formed between a step and a proximal lower step to prevent the tab 50 from sliding off the step to the lower step under an applied force and/or vibration.

Referring again to FIG. 1, the one or more tabs 50 can be formed on the extension ring 34. The tabs 50 can be formed on the exterior surface or outer circumference of the extension ring 34. As stated above, the extension ring 34 preferably has three tabs 50. The tabs 50 have a bottom surface which engages or rests on the steps 46 (FIG. 2). In addition, the tabs 50 can be sized and shaped to mate with the pockets 46 (FIG. 2).

The extension ring 34 can be vertically manipulated, indicated by arrow 58, with respect to the adaptor ring 30. For example, the extension ring 34 can be lifted vertically upwardly from the adaptor ring 30, and/or vertically placed on or in the adaptor ring 30. In addition, the extension ring 34 can be rotated, indicated by arrow 62, with respect to the adaptor ring 30. Thus, the extension ring 34 can be displaced vertically upwardly, and rotated, with respect to the adaptor ring 30 to position the extension ring 34 at a desired height with respect to the adaptor ring 30. For example, to increase the height or elevate the extension ring 34, the extension ring 34 is lifted and turned so that the tab 50 engages a higher step or pocket 46 (FIG. 2). With walls 54 extending to the top or upper edge of the adaptor ring 30, it may be necessary to completely remove the extension ring 34 from the adaptor ring 30 prior to rotation. Thus, the extension ring 34 can have a plurality of positions or rotational orientations with respect to the adaptor ring 30 which result in different heights or elevations of the extension ring 34. For example, the extension ring 34 can have a first position in which the tabs 50 rest on first steps or in first pockets 46 (FIG. 2,) to maintain the cover 14 at a first height, and at least a second position in which the tabs 50 rest on different second steps or in different second pockets at a different elevation to maintain the cover 14 at a different second height.

The extension ring 34 can be sized and shaped to extend into the adaptor ring 30. The extension ring 34 can have a vertical skirt or extension 66 with a length or height sized to completely cover the steps or pockets when the extension ring 34 is received within the adaptor ring 30, thus preventing access to any cavities created by the steps from inside the rings.

The adaptor ring 30 with steps 46 (FIG. 2) and the extension ring 34 with tabs 50 are one example of a height adjustment means for adjusting the height of the cover 14 relative to the frame 18. It is of course understood that other means can be used, including for example: exterior steps or pockets, and interior tabs; steps on the extension ring, and tabs on the adaptor ring; steps or tabs directly on the frame; a plurality of steps forming the tabs; various different numbers of sets of steps and/or tabs; etc. Other examples of height adjustment means are described below with respect to alternative embodiments. One advantage of the adaptor ring 30 and extension ring 34 is that they can be used with typical or existing frames 18 and covers 14.

Figure 3:
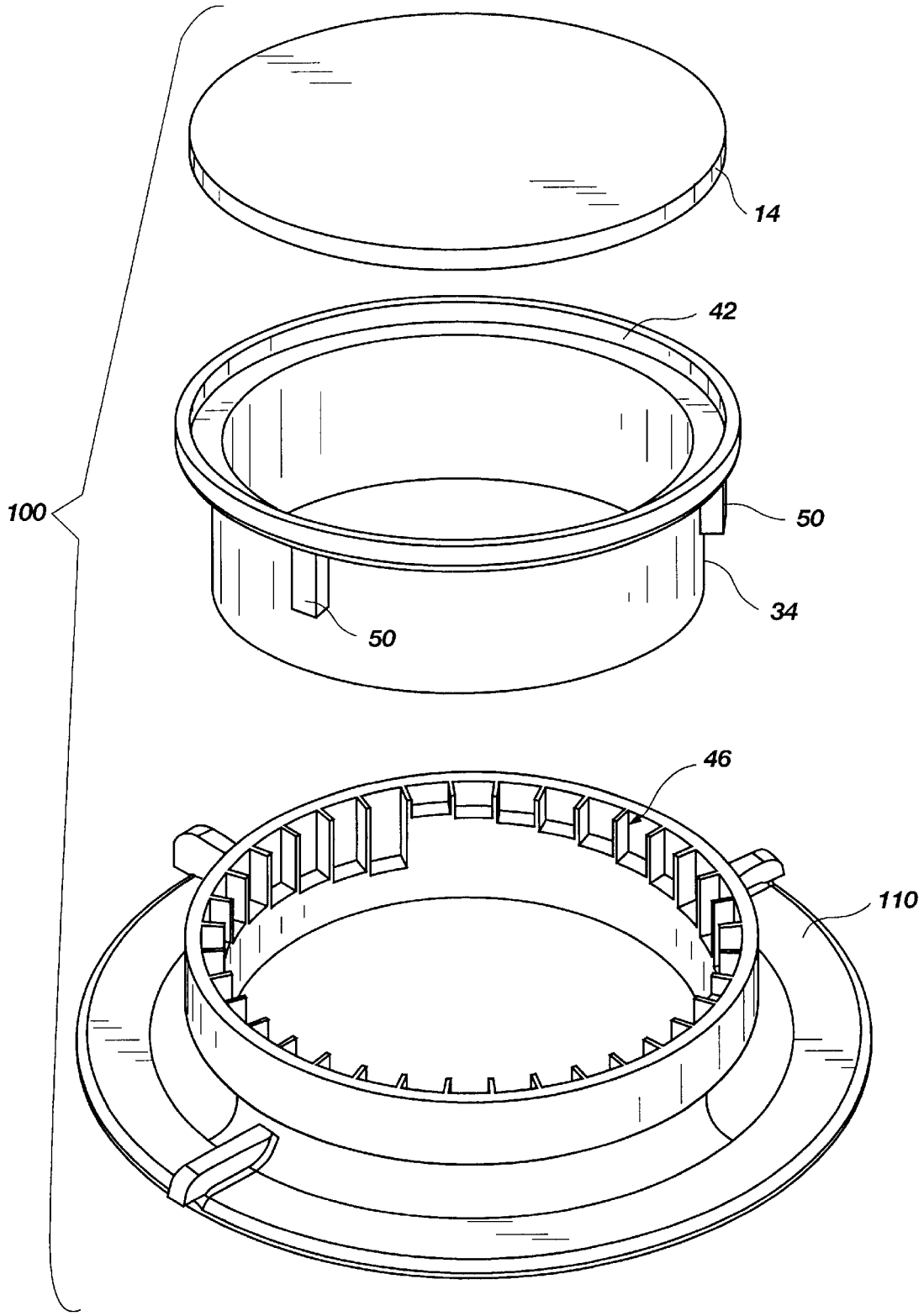
FIG. 3 is an exploded perspective view of another utility access device in accordance with the present invention.

Referring to FIG. 3, another height adjustable utility access device, indicated generally at 100, is shown, which is similar in many respect to the device 10 described above. The utility access device 100 includes a frame 110 with the plurality of steps or pockets 46 formed directly therein, thus eliminating the need for the separate adaptor described above. Again, the extension ring 34 with tabs 50, and the frame 110 with steps 46, is one example of a height adjustment means for adjusting the height of the cover relative to the frame. It is of course understood that other configurations are possible, including for example: external steps or pockets, and internal tabs; forming the steps in the extension ring and the tabs on the frame; etc.

Referring to FIG. 4, another height adjustable utility access device, indicated generally at 150, is shown. The utility access device 150 includes a frame 18 and a cover 14. The utility access device also includes an extension apparatus or height adjustment device 154 having first and second, or lower and upper, rings 158 and 162. The device 154 or rings 158 and 162 preferably can be disposed between the frame 18 and the cover 14. The first ring 158 can be disposed on the frame 18, while the second ring 162 is disposed on the first ring 158, and receives the cover 14. Like the embodiments described above, the height adjustment device 154 utilizes a plurality of steps.

Figure 5:
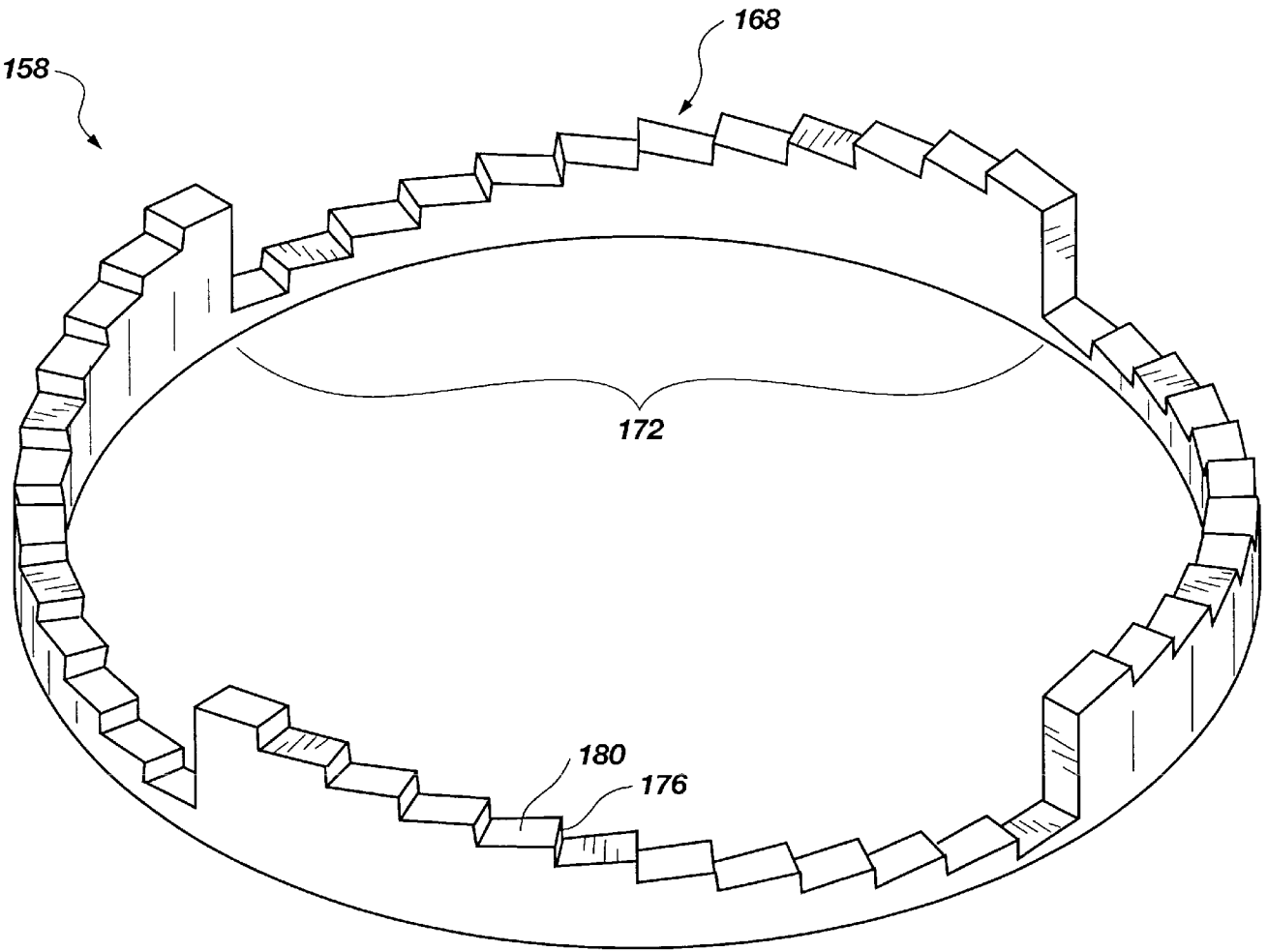
FIG. 5 is a perspective view of a height adjustment ring of the height adjustment mechanism of FIG. 4.

Referring to FIG. 5, a portion of the height adjustment device 154 is shown, namely the first or lower ring 158. The second or upper ring 162 can be a similar, but inverted ring. The lower and upper rings, illustrated by the lower ring 158, includes a plurality of steps 168. As described above, the steps 168 can include a plurality of sets 172 of steps. The steps 168 can increase uniformly in height or elevation from the bottom step to the top step. These steps 168 can be formed of a riser section 176 and a platform 180.

Figure 6:
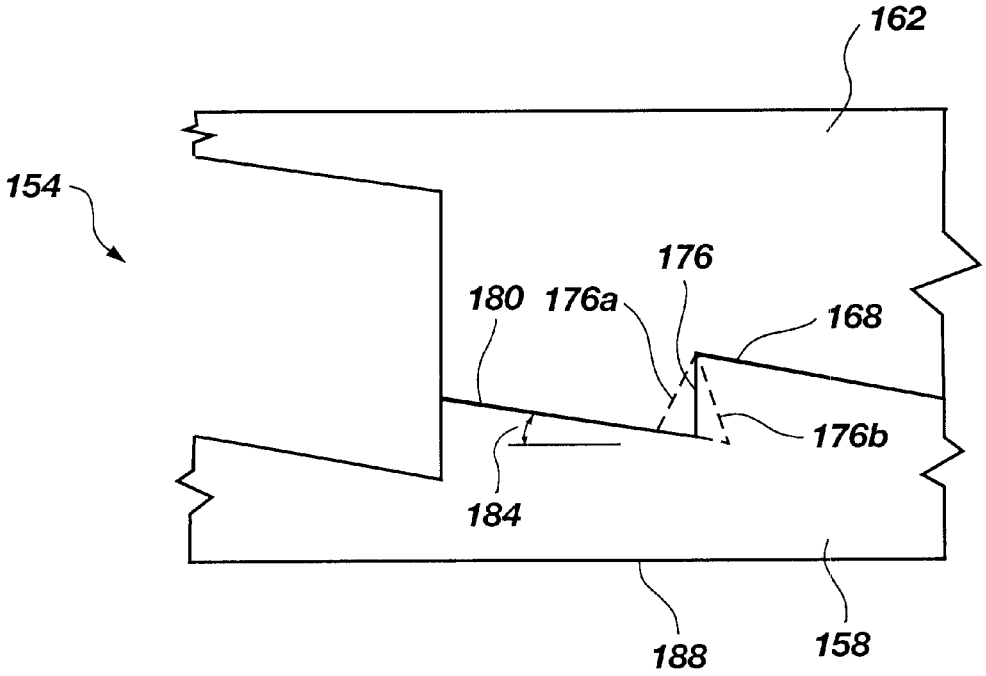
FIG. 6 is a partial, cross sectional side view of the height adjustment mechanism of FIG. 4.

Referring to FIG. 6, there is illustrated a portion of the adjusting unit 154. Specifically, the lower ring 158 is in a meshed position with the upper ring 162. Both rings have steps 168, resembling steps of a stairway, which preferably increase uniformly in height from a bottom step to a top step. Uniquely, it is noted that the platform 180 may have an angle 184, which would be angled from a base edge 188. Additionally, it is noted that the riser 176 may also be sloped in either direction 176*a* or 176*b*. The various riser angles allow for several advantages. For example, riser 176*a* makes it easier to move the height adjustment devise 154 from step to step, where riser 176*b* will actually make it harder to move the height adjustment devise 154 and actually hold the steps into position.

The operation of the height adjustment unit 154 can be viewed as a meshing action. Specifically, the upper ring 162 can be rotated and replaced onto the lower ring 158, and thereby meshing the steps 168 of both the rings 158 and 162, thus selecting an appropriate overall height.

The adjustable unit 154, or first and second rings 158 and 162, is another example of a height adjustment means. In addition, the rings 158 and 162 could also be made to be permanently fixed to each other by means of bolts, or pegs, or other secure means of bonding after having been adjusted. In a similar manner, the lower ring 158, could be made to securely and permanently fasten to the frame 18. Additionally, the cover 14 could be permanently fixed to the upper ring 162. Although the adjustable unit 154 is illustrated as fitting into the frame 18, it also can be modified to fit over the sides of frame 18. In addition, the rings 158 and 162 also could be made with appropriate hand-grips, or means of inserting external handles, to facilitate the workers in repositioning the height adjustment.

It is noted that adjustable unit 154 is illustrated to be positioned between the cover 14 and the frame 18. However, adjustable unit 154 can be placed below the frame 18, and above the manhole extension 26 and still achieve the same results.

It should be noted that most top manhole assemblies are of a fixed height design. In a typical installation the manhole is located in a road for access to a sewer. When a subsequent layer of material is added to the surface, the manhole covers are no longer flush with the road surface. In one application of the present invention, the height or elevation of the cover 14 is increased. This provides a cost effective and efficient means of adjusting the height of manhole cover assemblies to match the surrounding surface. It is further noted that the frames and rings described above are designed to withstand the full weight of any passing vehicle or other live load. The frames and rings can be made out of cast iron or other strong material.

It is further noted that the above embodiments show the sets of steps making a transition from a high step to a low step. The transition, however, can be from the highest step to any intermediate step. Thus, a pyramid shaped stepping sequence could also be employed. This would allow rotation in either direction.

Referring to FIG. 1, the frame 18 can include one or more protrusions 200 formed thereon and extending outwardly in a radial direction past the circumference or perimeter of the frame 18. Similarly, the adaptor ring 30 can include one or more protrusions 204. The protrusions 200 and 204 preferably are plate like or have flat faces. The protrusions 200 and 204 form, or act as, anchors to resist movement and/or pivoting of the frame 18 or adaptor ring 30 after installation. Typically, concrete or asphalt is poured around the frame 18 and adaptor ring 30, and thus around the protrusions 200 and 24.

Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function, manner of operation, assembly, and use may be made without departing from the principles and concepts set forth herein.

What is claimed is:

1. A height adjustable utility access device, comprising:

a) a frame, configured to be secured over a utility, having an opening therethrough;

b) an adaptor ring, disposable on the frame;

c) a plurality of steps, formed on the adaptor ring at different elevations;

d) an extension ring, selectively disposable on the adaptor ring;

e) at least one tab, attached to the extension ring, and selectively engagable with at least one of the plurality of steps to selectively elevate the extension ring with respect to the adaptor ring and the frame;

f) a cover, removably disposed on the extension ring; and g) a skirt, extending from the extension ring and extendable into the adaptor ring, having a length sized to extend to at least a lowest step in the adaptor ring to cover cavities above the plurality of steps when the extension ring is disposed on the adaptor ring.

2. A device in accordance with claim 1, wherein each step includes a wall disposed between the step and a proximal lower step to prevent the at least one tab from inadvertently moving from the step to the proximal lower step.

3. A device in accordance with claim 1, wherein the plurality of steps are formed by a plurality of pockets formed about a circumference of the opening having bottoms disposed at different elevations.

4. A device in accordance with claim 1, further comprising:

at least one projection, extending outwardly from the frame and past a perimeter thereof.

5. A device in accordance with claim 1, wherein the utility access is a manhole; and wherein the frame is configured to be attached to a manhole extension.

6. A device in accordance with claim 1, wherein the plurality of steps are formed in an inner surface of the adaptor ring; and wherein the at least one tab is formed on an outer surface of the extension ring.

7. A device in accordance with claim 1, wherein:

the frame has an upper edge sized and shaped to receive the cover;

the adaptor ring has a lower edge sized and shaped to be received by the upper edge of the frame; and the extension ring has an upper edge sized and shaped to receive the cover.

* * * * *